US006161441A

United States Patent [19]

Ghorashi et al.

[11] Patent Number: 6,161,441

[45] Date of Patent: Dec. 19, 2000

[54] FIBER INDIVIDUALIZER

[75] Inventors: Hossein M. Ghorashi; Joseph H. Mansfield; Luo Cheng, all of Knoxville, Tenn.

[73] Assignee: Zellweger Uster, Inc., N.C.

[21] Appl. No.: 08/996,557

[22] Filed: Dec. 23, 1997

[51] Int. Cl.[7] ..... G01N 1/00

[52] U.S. Cl. ..... 73/863.92; 73/159; 73/160; 19/19; 19/65 R

[58] Field of Search ..... 73/863.92, 159, 73/160; 19/35, 65 R, 239, 244, 246, 247, 242

[56] References Cited

U.S. PATENT DOCUMENTS

| | | | |
|---|---|---|---|
| 3,744,093 | 7/1973 | Felix | 19/240 |
| 4,192,041 | 3/1980 | Sasaki et al. | 19/244 |
| 4,592,114 | 6/1986 | Stahlecker | 19/239 |
| 4,891,872 | 1/1990 | Sussman | 28/244 |
| 4,980,957 | 1/1991 | Sussman | 28/244 |
| 5,014,398 | 5/1991 | Stahlecker et al. | 19/244 |
| 5,161,111 | 11/1992 | Oehler et al. | 364/470 |
| 5,295,401 | 3/1994 | Toedtli | 73/863.92 |
| 5,367,747 | 11/1994 | Shofner et al. | 19/65 |
| 5,452,626 | 9/1995 | Denz | 74/665 |
| 5,796,635 | 8/1998 | Dammig | 19/239 |

OTHER PUBLICATIONS

Loptex, Optalyser OP 300 brochure, date unknown.

Schlichter, Trutzschler nep tester NT: a new visual method to analyze neps and interfering particles, Textile Praxis International, pp. 28–29, Sep., 1991.

Trutzschler, Nep Tester NT brochure, date unknown.

Lintronics, Fiber Contamination Tester brochure, date unknown.

Lieberman and Zhao, Categorizing Cotton Trash Shapes Using Video Imagery, Beltwide Cotton Conference, pp. 854–858, 1991.

Lieberman, Bragg, and Brennan, Determining Gravimetric Bark Content in Cotton with Machine Vision, Textile Res. J., pp. 94–104, Feb. 1998.

Zellweger Uster, Uster LVI brochure, date unknown.

Zellweger Uster, Uster Micronaire 775 brochure, date unknown.

Zellweger Uster, Uster HVI 900 brochure, date unknown.

Peyer, texLAB brochure, date unknown.

Peyer, FL–100 manual (2 pages only), date unknown.

Benardin, Delfosse, Measurement of fiber lengths distribution on raw wool, Melliand International, pp. 70–74, Feb., 1996.

Motion Control, breaker drawings (2), Oct., 1994.

*Primary Examiner*—Hezron Williams
*Assistant Examiner*—Nashmiya Fayyaz
*Attorney, Agent, or Firm*—Luedeka, Neely & Graham, P.C.

[57] ABSTRACT

An apparatus that individualizes fibers within a feed stream without breaking the fibers. A first stage, having first pinch rollers, receives the feed stream and provides it to a second stage. The second stage receives the feed stream from the first stage, and provides a thinned stream to a third stage. Second stage apron belts draw the feed stream under tension from the first stage into the second stage. Second pinch rollers draw the feed stream under tension from the second stage apron belts and provide the thinned stream to the third stage. The third stage receives the thinned stream from the second stage and provides individualized fibers. Third stage apron belts draw the thinned stream under tension from the second stage into the third stage. Third pinch rollers draw the thinned stream under tension from the third stage apron belts and provide the individualized fibers.

30 Claims, 2 Drawing Sheets

FIBER INDIVIDUALIZER

FIELD

In general, the present invention relates to fiber processing. In particular, the present invention relates to a device for individualizing wool fibers without breaking the fibers.

BACKGROUND

Currently, the fiber industry typically measures physical properties of wool fibers in bulk form. By "bulk form" it is meant that many wool fibers, such as in a toe, are measured at the same time and the properties of the toe are ascribed to the individual fibers. It may be more accurate, at times, to measure the properties of individual wool fibers, rather than to take bulk measurements. However, wool fibers tend to be very difficult to a individualize. One reason for this is that wool fibers are comparatively longer than many other fibers. Thus, wool fibers are difficult to handle and are easily broken when individualized. These and other difficulties have caused the wool industry to predominantly use bulk measurements, rather than individual measurements.

It would therefore be desirable to have an apparatus for individualizing long fibers contained within a feed stream of wool, which will not break the wool fibers during individualizing.

SUMMARY

The above and other needs are met by an apparatus that individualizes fibers within a feed stream without breaking the fibers. A first stage, having first pinch rollers, receives the feed stream and provides it to a second stage. The second stage receives the feed stream from the first stage, and provides a thinned stream to a third stage. Second stage apron belts draw the feed stream under tension from the first stage into the second stage. Second pinch rollers draw the feed stream under tension from the second stage apron belts and provide the thinned stream to the third stage. The third stage receives the thinned stream from the second stage and provides individualized fibers. Third stage apron belts draw the thinned stream under tension from the second stage into the third stage. Third pinch rollers draw the thinned stream under tension from the third stage apron belts and provide the individualized fibers.

The first, second, and third pinch rollers act as constant speed stages, in which the fibers are maintained at a constant speed for the entire time during which they are held by these pinch rollers. The second and third stage apron belts act as variable speed stages which transport and apply an acceleration force to each fiber, and then accelerate the fiber individually when the fiber's trailing end passes from the immediately preceding pinch roller, and which allow a fiber to further accelerate when the leading end of the fiber is acquired by the next pinch roller. Thus, fibers between the apron belts may be moving at any one of three different speeds. By successively thinning the feed stream through each of the three stages, the feed stream is reduced from a toe of fibers to individualized fibers. The individualized fibers can be drawn off one at a time to an analyzer, where they are measured for physical characteristics, such as length, color, or strength. Thus, the present invention allows such measurements to be made on fibers individually, and thus reduces the inaccuracies which may be inherent in making the measurements on the toe in bulk form.

In the preferred embodiment, second platens and third platens are disposed adjacent the second stage apron belts and third stage apron belts respectively. The platens provide pressure on the feed stream and thinned stream, and allow the fibers to slip to a controlled degree. Most preferably, at least one each of the second platens and third platens is a pressure platen, for adjusting the pressure on the feed stream between the second stage apron belts and the thinned stream between the third stage apron belts.

Stepper motors drive each of the first, second, and third pinch rollers and the second and third stage apron belts, and a speed control separately controls the rotation rates of each. The first pinch rollers rotate at a rate of about 5 rpm, the second stage apron belts rotate at a rate of about 15 rpm, the second pinch rollers rotate at a rate of about 30 rpm, the third stage apron belts rotate at a rate of about 60 rpm, and the third pinch rollers rotate at a rate of between about 300 rpm and about 400 rpm.

A vacuum nozzle is disposed adjacent the third stage, for drawing individualized fibers from the third stage with a non-turbulent air flow. An analyzer receives the individualized fibers from the vacuum nozzle, and detect physical properties of the individualized fibers, such as length.

The first, second, and third stages and the vacuum nozzle are adjustably mounted to a track, for increasing and decreasing gaps between the first, second, and third stages and the vacuum nozzle. There is a first gap of between about one-half inches and about four and one-half inches between the first and second stage, a second gap of between about one-half inches and about six and one-half inches between the second and third stages, and a third gap of between about zero inches and about one-quarter inches between the third stage and the vacuum nozzle.

First adjustable pressure means adjust the pressure between the first pinch rollers, and prevent the fibers within the feed stream from slipping between the first pinch rollers. Similarly, second adjustable pressure means adjust the pressure between the second pinch rollers, and prevent the fibers within the thinned stream from slipping between the second pinch rollers. Likewise, third adjustable pressure means adjust the pressure between the third pinch rollers and prevent the individualized fibers from slipping between the third pinch rollers.

Second air knives disposed adjacent the second pinch rollers, and third air knives disposed adjacent the third stage apron belts, remove fibers from the second pinch rollers and the third stage apron belts respectively. Preferably, the fibers are wool and the feed stream is toe.

In a method for individualizing fibers within a feed stream, without breaking the fibers, the feed stream is provided to first pinch rollers that are rotating at a given speed. The pressure between the first pinch rollers is increased until the fibers of the feed stream do not slip between them. The fibers are drawn under tension from the first pinch rollers and between a second upper and a second lower apron belts, which are rotating at a speed greater than the speed of the first pinch rollers. The pressure on the fibers between the second stage apron belts is adjusted to allow a controlled degree of slip between the fibers. The fibers are drawn under tension from the second stage apron belts to second pinch rollers that are rotating at a speed greater than the speed of the second stage apron belts. The pressure between the second pinch rollers is increased until the fibers do not slip between the second pinch rollers.

As before, the fibers are drawn under tension from the second pinch rollers between a third upper and a third lower apron belts, which are rotating at a speed greater than the speed of the second pinch rollers. The pressure on the fibers between the third stage apron belts is adjusted to allow a controlled degree of slip between the fibers. In a manner similar to that explained above, the fibers are drawn under tension from the third stage apron belts to third pinch rollers, which are rotating at a speed greater than the speed of the third stage apron belts. The pressure between the third pinch rollers is increased until the fibers do not slip between the third pinch rollers. The fibers are released from the third pinch rollers as individualized fibers.

The method described individualizes fibers by drawing them into each successive stage at ever increasing rates of speeds. As the fibers pass through alternate sets of pinch rollers and apron belts, those fibers that are slightly ahead of other fibers in the feed stream, or in other words, those fibers that enter each set of rollers or belts prior to other fibers in the feed stream, are drawn ahead of the fibers behind it. In this manner the feed stream is quickly drawn and thinned to the point that individualized fibers are produced.

BRIEF DESCRIPTION OF THE DRAWINGS

Other objects, features and advantages of the present invention will become apparent by reference to the following detailed description when considered in conjunction with the accompanying drawings, which are not to scale, wherein like reference numbers refer to like elements throughout the several views, and wherein.

DESCRIPTION OF THE PREFERRED EMBODIMENTS

Figure 1:
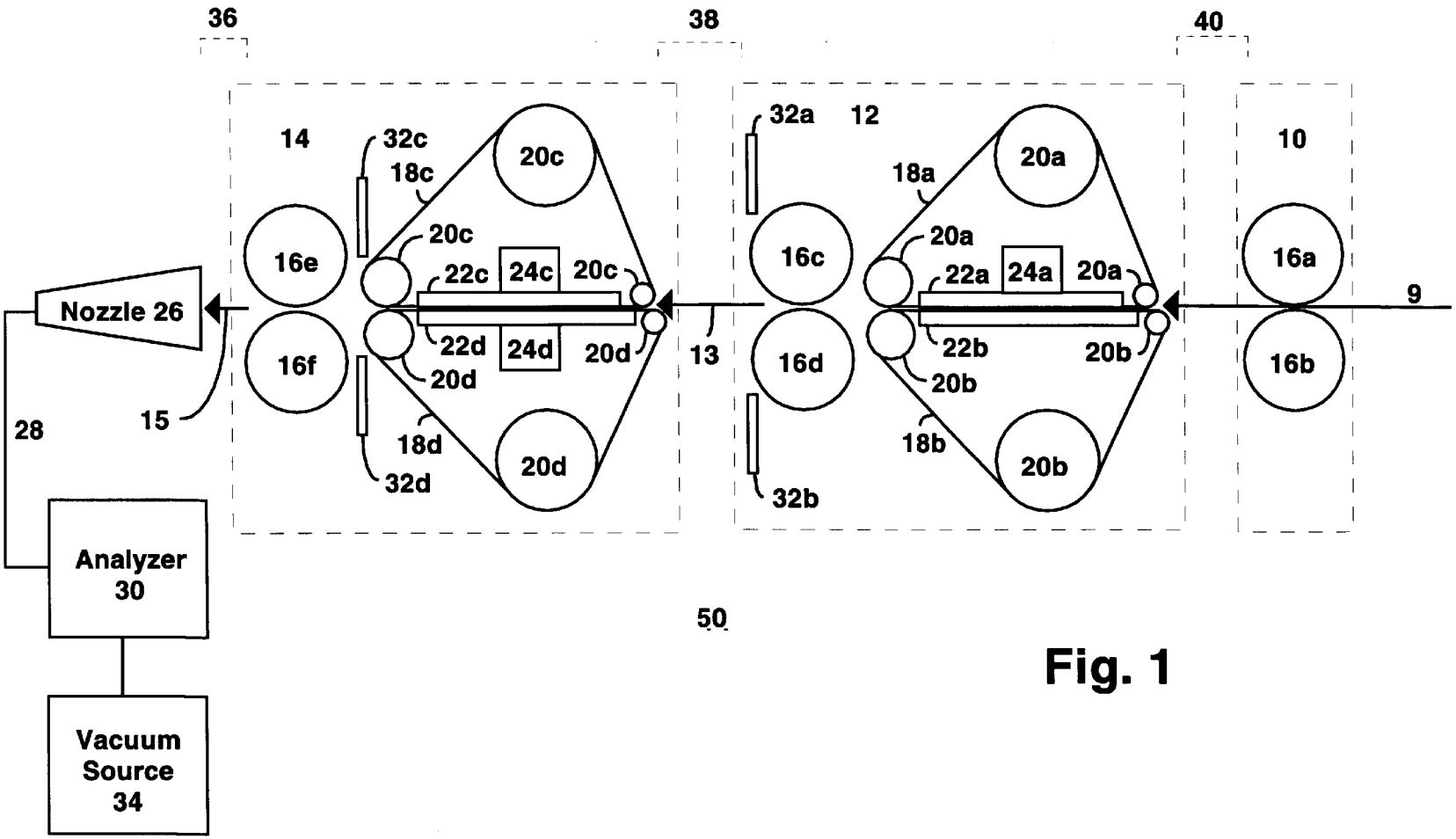
FIG. 1 is a functional diagram of an apparatus of the present invention.

Shown in FIG. 1 is an individualizer 50 for individualizing fibers contained within a feed stream 9 without breaking the fibers. Preferably, the feed stream 9 is a toe of wool, but it could also be a sliver of cotton or some other fibrous material. The fibers of the feed stream 9 are substantially parallel within the feed stream 9, but are not aligned as to where they begin or end within the feed stream 9. In other words, the fibers overlap one another along their length within the feed stream 9, such that the feed stream 9 is a long cord of unwoven fibers. Further, the fibers of the feed stream 9 are not substantially twisted together, as are the fibers of a rope. Thus, it is primarily the friction between the individual fibers within the feed stream 9 that keeps the feed stream 9 together in a long cord.

Figure 2:
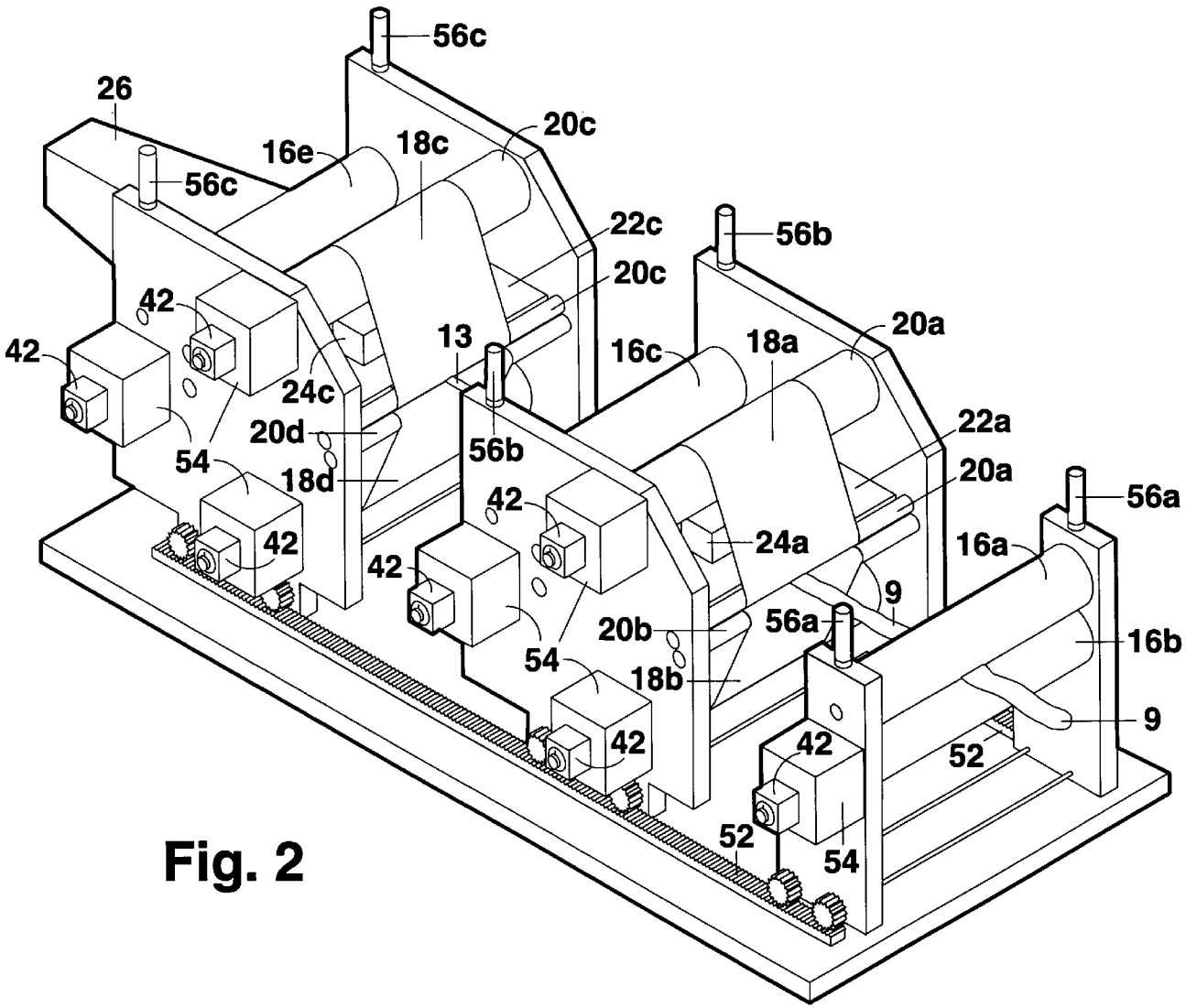
FIG. 2 is a partial perspective view of the apparatus of the present invention.

A first stage 10 receives the feed stream 9 into the individualizer 50. In the preferred embodiment the first stage 10 has a fixed position. However, in an alternate embodiment the first stage 10 is adjustably mounted on a track 52 (depicted in FIG. 2), such that the first stage 10 can be moved and releasably affixed along the length of the track 52. This may be accomplished in any one or more of several different ways.

For example, the track 52 may comprise one or more straight bars, either square or circular in cross-section, and the first stage 10 has clamps designed to fit around the bars. The clamps are loosened so that the first stage 10 can slide and be adjusted in position along the length of the bars, and then the clamps are tightened to affix the first stage 10 in the desired position. Alternately, the track 52 could be one or more lead screws, with the bearing portions of the lead screws attached to the first stage 10. The lead screws of the track are then rotated to move the first stage 10 forward or backward along the track 52, and the first stage 10 is then held in place by the threads of the lead screws when they are no longer rotated, thus affixing the first stage 10 in place. Further, the track 52 may be one or more toothed rails which mesh with gears attached to the first stage 10. The gears may be motorized to advance the first stage 10 back and forth along the length of the track 52. The internal resistance of the motors may then keep the first stage 10 in the desired location. Of course, any combination of these methods may also be used to affix the first stage 10 to the track 52, and many other methods and devices could also be readily adapted, and are within the spirit of this disclosure.

The first stage 10 includes first pinch rollers 16*a* and 16*b*, for drawing the feed stream 9 into the first stage 10. As used herein the designations such as "first," "second," or "third" do not necessarily indicate how many of an element may be present in an embodiment, but rather tend to indicate the stage in which the element is disposed. Preferably, one of the first pinch rollers 16*a* and 16*b* is rubber and the other is stainless steel. However, in alternate embodiments, both of the first pinch rollers 16*a* and 16*b* are either rubber or some other elastomeric material, or stainless steel or some other hard material. The first pinch rollers 16*a* and 16*b* may be ribbed along their length to provide increased surfaces and edges for friction between the first pinch rollers 16*a* and 16*b* and the fibers of the feed stream 9 which pass between them.

First adjustable pressure means 56*a* (depicted in FIG. 2) are used to adjust the pressure between the first pinch rollers 16*a* and 16*b*. The first adjustable pressure means 56*a* may be provided by one or more of several different mechanisms. For example, the ends of the first pinch rollers 16*a* and 16*b* may each be mounted to a screw, with one end of the upper first pinch roller 16*a* at one end of the screw, and the corresponding end of the lower first pinch roller 16*b* at the other end of the screw, with a similar configuration at the other ends of the first pinch rollers 16*a* and 16*b*. In this manner, when the screws are rotated in one direction, the first pinch rollers 16*a* and 16*b* are drawn toward one another, and when the screws are rotated in the other direction the first pinch rollers 16*a* and 16*b* are pushed apart from each other.

As another example, one of the first pinch rollers 16*a* and 16*b* may be placed in an affixed position and the other of the first pinch rollers 16*a* and 16*b* may be adjustable toward and away from the affixed roller. This may be accomplished by mounting one of the first pinch rollers 16*a* and 16*b* on thumb screws, which can be adjusted to move the first pinch roller 16*a* or 16*b* back and forth. Further, pressurized cylinders, either hydraulically or pneumatically powered, may be attached to the movable first pinch roller 16*a* or 16*b*, to provide the pressure between the first pinch rollers 16*a* and 16*b*. Of course, there are several other devices which may also be employed to provide pressure between the first pinch rollers 16*a* and 16*b*, which other devices are contemplated by the invention and are within the scope of this disclosure.

The materials from which the first pinch rollers 16*a* and 16*b* are formed are selected in part on their ability to firmly grasp and provide friction to the fibers of the feed stream 9. The adjustable pressure between the first pinch rollers 16*a* and 16*b* is also provided, in part, to enhance the ability of the first pinch rollers 16*a* and 16*b* to provide friction to the fibers of the feed stream 9. In this manner, the fibers of the feed stream 9 preferably do not slip between the first pinch rollers 16*a* and 16*b*. By this it is meant that the fibers of the feed stream 9 will preferably retain their position relative to one another along the length of the feed stream 9 for the entire time that they are engaged between the first pinch rollers 16*a* and 16*b*. The importance of retaining the fibers of the feed stream 9 between the first pinch rollers 16*a* and 16*b* such that they cannot slip past one another is described in greater detail below.

The first pinch rollers 16*a* and 16*b* are rotated at the same speed and in opposing directions, so that the feed stream 9 placed between them is drawn between the first pinch rollers 16*a* and 16*b* and ejected out from between the first pinch rollers 16*a* and 16*b* on the other side. A stepper motor 54 (depicted in FIG. 2) provides the rotation for the first pinch rollers 16*a* and 16*b*, and a speed control 42 (depicted in FIG. 2), in communication with the stepper motor 54, controls the speed at which the first pinch rollers 16*a* and 16*b* rotate. The first pinch rollers 16*a* and 16*b* rotate at a first given speed, which in the preferred embodiment is about 5 rotations per minute (rpm). The significance of this speed is described in greater detail below.

A second stage 12 is disposed adjacent the first stage 10, and is also mounted on the track 52 (depicted in FIG. 2) in a manner similar to that described above in great detail for the first stage 10. The second stage 12 receives the feed stream 9 from the first stage 10, and provides a thinned stream 13. Second stage apron belts 18*a* and 18*b* receive the feed stream 9, and draw the feed stream 9 under tension between the second stage apron belts 18*a* and 18*b*. The second stage apron belts 18*a* and 18*b* are preferably an elastomeric material such as rubber, that provides a relatively great degree of friction between the fibers of the feed stream 9 and the second stage apron belts 18*a* and 18*b*.

The second stage apron belts 18*a* and 18*b* are preferably tensionally secured about sets 20*a* and 20*b* of two or more rollers. In this manner, when any one of the rollers 20*a* and 20*b* are rotated, the second stage apron belts 18*a* and 18*b* are also rotated. The rotational power to the second stage apron belts 18*a* and 18*b* is provided by a stepper motor 54 (depicted in FIG. 2). The second stage apron belts 18*a* and 18*b* are driven in opposing rotational directions, such that the feed stream 9 which is received between them is drawn in between them and ejected out from between them on the other side.

The directions of rotation are selected to coincide with the directions of rotation of the first pinch rollers 16*a* and 16*b*. In other words, the second upper apron belt 20*a* and the first upper pinch roller 16*a* are rotating in a first direction, and the second lower apron belt 20*b* and the first lower pinch roller 16*b* are rotating in a second direction. The result of this configuration is that the feed stream 9 entering between the first pinch rollers 16*a* and 16*b* is urged in one direction along a path between the first pinch rollers 16*a* and 16*b* and the second stage apron belts 18*a* and 18*b*.

The speed at which the second stage apron belts 18*a* and 18*b* rotate is controlled by the speed control 42 (depicted in FIG. 2), and is independently variable depending on the draft ratio required. The rotational speed of the second stage apron belts 18*a* and 18*b* is greater than the speed at which the first pinch rollers 16*a* and 16*b* rotate, and the significance of this relationship is explained in greater detail below. In the preferred embodiment, the rotational speed of the second stage apron belts 18*a* and 18*b* is about 15 rpm.

Second platens 22*a* and 22*b* are disposed adjacent and on opposing sides of the second stage apron belts 18*a* and 18*b*. Because the second stage apron belts 18*a* and 18*b* are preferably constructed of an elastomeric material, the second platens 22*a* and 22*b* provide some rigidity and resistance to the second stage apron belts 18*a* and 18*b* along a distance between the rollers 20*a* and 20*b* on which the second stage apron belts 18*a* and 18*b* are mounted. This rigidity and resistance helps to enhance the friction between the second stage apron belts 18*a* and 18*b* and the feed stream 9 which is drawn between them. The platens 22*a* and 22*b* are preferably made of metal but could also be made of plastic, glass, or some other smooth, resilient material which has a low coefficient of friction so as to not cause excessive wear to the aprons.

The pressure between the second stage apron belts 18*a* and 18*b* and the fibers of the feed stream 9 is further enhanced by placing a pressure module 24*a* adjacent one or both of the second platens 22*a* and 22*b*. In FIG. 1, a pressure module 24*a* is depicted adjacent the second upper platen 22*a*, which makes the second upper platen 22*a* a pressure platen. The pressure module 24*a* may be a mechanical, hydraulic, or pneumatic device as described above, and is provided to further enhance and finely control the pressure exerted by the second stage apron belts 18*a* and 18*b* on the fibers of the feed stream 9.

Unlike the first pinch rollers 16*a* and 16*b*, which are designed to allow no slip between the fibers of the feed stream 9, the components of the portion of the second stage 12 described above, being the second stage apron belts 18*a* and 18*b*, the rollers 20*a* and 20*b*, the platens 22*a* and 22*b*, and the pressure module 24*a*, are designed to allow a controlled degree of slip between the fibers of the feed stream 9. Thus, when the fibers are between the second stage apron belts 18*a* and 18*b*, it is intended that some of the fibers are advanced through the second stage apron belts 18*a* and 18*b* at a faster rate than others of the fibers in the feed stream 9. As fibers exit from between the second stage apron belts 18*a* and 18*b* at a greater rate than that at which they enter, due in part to the second stage apron belts 18*a* and 18*b* rotating faster than the first pinch rollers 16 and 16*b*, the feed stream 9 is thinned as it moves between the second stage apron belts 18*a* and 18*b*. In other words, the fibers within the feed stream 9 are partially, but not completely individualized as they move through the second stage 12. This is explained in greater detail below.

At the exit of the second stage apron belts 18*a* and 18*b*, the fibers of the feed stream 9 are received by second pinch rollers 16*c* and 16*d*. The second pinch rollers 16*c* and 16*d* are preferably configured in a manner very similar to the first pinch rollers 16*a* and 16*b*. In other words, one of the second pinch rollers 16*c* and 16*d* is preferably rubber and the other is preferably stainless steel. In alternate embodiments, both of the second pinch rollers 16*c* and 16*d* are either rubber or some other elastomeric material, or stainless steel or some other hard material. The second pinch rollers 16*c* and 16*d* may be ribbed along their length to provide increased surfaces and edges for friction between the second pinch rollers 16*c* and 16*d* and the fibers of the feed stream 9 which pass between them.

Second adjustable pressure means 56*b* (depicted in FIG. 2) are used to adjust the pressure between the second pinch rollers 16*c* and 16*d*. The second adjustable pressure means 56*b* may be provided by one or more of several different mechanisms as explained above. As mentioned above for the first pinch rollers 16*a* and 16*b*, the materials from which the second pinch rollers 16*c* and 16*d* are formed are selected in part on their ability to firmly grasp and provide friction to the fibers of the feed stream 9. The adjustable pressure between the second pinch rollers 16*c* and 16*d* is also provided, in part, to enhance the ability of the second pinch rollers 16*c* and 16*d* to provide friction to the fibers of the feed stream 9. In this manner, the fibers of the feed stream 9 preferably do not slip between the second pinch rollers 16*c* and 16*d*.

Similar to that as previously described, the second pinch rollers 16*c* and 16*d* are rotated at the same speed and in opposing directions, so that the feed stream 9 placed between them is drawn between the second pinch rollers 16*c* and 16*d* and ejected out from between the second pinch rollers 16*c* and 16*d* on the other side. A stepper motor 54 (depicted in FIG. 2) provides the rotation between the second pinch rollers 16*c* and 16*d*, and the speed control 42 (depicted in FIG. 2), in communication with the stepper motor 54, independently controls the speed at which the second pinch rollers 16*c* and 16*d* rotate. Preferably, the second pinch rollers 16*c* and 16*d* rotate at a speed that is greater than the speed at which the second stage apron belts 18*a* and 18*b* rotate. In the preferred embodiment, the second pinch rollers 16*c* and 16*d* rotate at a speed of about 30 rpm.

Thus, the fibers of the feed stream 9 are accelerated as they move through the first pinch rollers 16*a* and 16*b*, the second stage apron belts 18*a* and 18*b*, and the second pinch rollers 16*c* and 16*d*. This acceleration tends to thin out the feed stream 9 as briefly described above. To continue the explanation of how this is accomplished, as the fibers of the feed stream 9 pass through the first pinch rollers 16*a* and 16*b*, the trailing ends of each of the fibers are retainably held between the first pinch rollers 16*a* and 16*b*. The leading ends of the fibers, however, are tensionally drawn between the second stage apron belts 18*a* and 18*b*.

The first pinch rollers 16*a* and 16*b*, because they exert sufficient pressure on the fibers so that they are not released, prevent the fibers from being pulled through the second stage 12 at the faster rate at which the second stage apron belts 18*a* and 18*b* are rotating. Thus, the second stage apron belts 18*a* and 18*b* are dragging past the fibers at a greater speed than that at which they are allowed to travel by the first pinch rollers 16*a* and 16*b*. This is the importance of the pressure between the first pinch rollers 16*a* and 16*b* being sufficient to retain the fibers of the feed stream 9: so that the fibers are not dragged from between the first pinch rollers 16*a* and 16*b* until the end of the fiber is released from between the first pinch rollers 16*a* and 16*b*.

As the trailing end of an individual fiber is released from between the first pinch rollers 16*a* and 16*b*, the pressure exert on the fiber by the second stage apron belts 18*a* and 18*b* cause the fiber to accelerate to the speed of the second stage apron belts 18*a* and 18*b*. Thus, the fiber so released are accelerated past, and drawn out from between the other fibers of the feed stream 9 that are still retained between the first pinch rollers 16*a* and 16*b*. This action tends to thin and elongate the feed stream 9, which is a partial step toward the goal of individualizing the fibers. In other words, in the limit, as the feed stream 9 becomes longer and thinner, there ultimately comes a point at which the feed stream 9 contains only a single fiber at any point along its cross-section.

As mentioned above, the pressure between the second stage apron belts 18*a* and 18*b* provides a controlled degree of slip between the fibers of the feed stream 9. If the pressure between the second stage apron belts 18*a* and 18*b* is too great, it tends to break the fibers which have not yet been released from the first pinch rollers 16*a* and 16*b*. If the pressure between the second stage apron belts 18*a* and 18*b* is not great enough, then it is insufficient to overcome the friction between the fibers themselves and accelerate the fibers that have been released from the first pinch rollers 16*a* and 16*b* past the other fibers of the feed stream 9 that have not yet been released from the first pinch rollers 16*a* and 16*b*. Similarly, if the pressure between the first pinch rollers 16*a* and 16*b* is not great enough to prevent the fibers of the feed stream 9 from slipping out between them, then the fibers may be pulled out by the pressure exerted between the second stage apron belts 18*a* and 18*b*, and the fibers will not be thinned in a uniform manner.

There is a first gap 40 of between about one-half inches and about four and one-half inches between the first stage 10 and the second stage 12. The width of this gap 40 is selected based in part on the length of the fibers within the feed stream 9 that are processed through the individualizer 50. Preferably, the first gap 40 is set so that the distance between the first pinch rollers 16*a* and 16*b* and the second pinch rollers 16*c* and 16*d* is at least just greater than the length of the longest fibers in the feed stream 9. The reason for this is that both the first pinch rollers 16*a* and 16*b* and the second pinch rollers 16*c* and 16*d* exert sufficient pressure on the fibers such that the fibers are retainably held by both the first pinch rollers 16*a* and 16*b* and the second pinch rollers 16*c* and 16*d*.

Thus, if the first pinch rollers 16*a* and 16*b* and the second pinch rollers 16*c* and 16*d* were close enough together such that a fiber were held by both the first pinch rollers 16*a* and 16*b* and the second pinch rollers 16*c* and 16*d*, the fiber would be broken or stretched by the individualizer 50. This is because the second pinch rollers 16*c* and 16*d* are rotating at a much greater rate of speed than are the first pinch rollers 16*a* and 16*b*. Thus, the second pinch rollers 16*c* and 16*d* would try to pull the fiber faster than the first pinch rollers 16*a* and 16*b* could release it. Because the friction between the first pinch rollers 16*a* and 16*b* and the second pinch rollers 16*c* and 16*d* is great enough so that fibers cannot slip from between them, the fiber would be broken. This would tend to invalidate any subsequent readings taken on the individualized fibers, such as length measurements.

In a manner similar to that in which leading fibers are drawn out ahead of trailing fibers as the fibers exit the first pinch rollers 16*a* and 16*b* and enter the second stage apron belts 18*a* and 18*b*, so also are leading fibers drawn out ahead of trailing fibers as the fibers enter the second pinch rollers 16*c* and 16*d*. Because the second pinch rollers 16*c* and 16*d* rotate at a faster speed than do the second stage apron belts 18*a* and 18*b*, the second pinch rollers 16*c* and 16*d* cause the fibers which are drawn into them to slip past other fibers at a rate of speed that is greater than the speed of the second stage apron belts 18*a* and 18*b* and the speed of the first pinch rollers 16*a* and 16*b*.

Thus, fibers within the feed stream 9 are moving at three different speeds in the area between the second stage apron belts 18*a* and 18*b*. The slowest moving fibers are those which are still retained between the first pinch rollers 16*a* and 16*b* and which are moving at the same speed as the first pinch rollers 16*a* and 16*b*. Accelerating past the slowest fibers are those which have been released from the first pinch rollers 16 and 16*b* and which are moving at the speed of the second stage apron belts 18*a* and 18*b*. Accelerating past both these slower two groups of fibers are those which have been drawn in by the second pinch rollers 16*c* and 16*d* and which are moving at the speed of the second pinch rollers 16*c* and 16*d*. Thus, these three speeds at which the fibers are moving tend to draft the feed stream 9, thinning it and elongating it, and providing a thinned stream 13 at the outlet of the second stage 12.

The rate of speed at which the second pinch rollers 16*c* and 16*d* are rotating is sufficient that fibers may tend to wrap around the second pinch rollers 16*c* and 16*d*, rather than being conducted along with the other fibers and being further processed. To reduce the occurrence of fibers wrapping around the second pinch rollers 16*c* and 16*d* in this manner, means are provided to urge the fibers of the thinned stream 13 along the proper path. Several different methods may be used to accomplish this.

For example, blades may be placed along the second pinch rollers 16*c* and 16*d* at a position just rotationally after the point at which the fibers of the thinned stream 13 are released from the second pinch rollers 16*c* and 16*d*. In this manner, fibers which have a tendency to follow the direction of rotation and wrap around the second pinch rollers 16*c* and 16*d* encounter the blades and are redirected along the proper path.

Preferably, air knives 32*a* and 32*b* are used to keep the fibers within the thinned stream 13. The air knives 32*a* and 32*b* are a series of air jets which are placed along the lengths of the second pinch rollers 16*c* and 16*d* and are directed at the output side of the second pinch rollers 16*c* and 16*d*. The air jets from the air knives 32*a* and 32*b* are directed in a substantially tangential manner to the second pinch rollers 16*c* and 16*d*. The air jets tend to blow the fibers of the thinned stream 13 off the edges of the second pinch rollers 16*c* and 16*d*, and into the proper path for further processing.

As the fibers of the thinned stream 13 exit the second pinch rollers 16*c* and 16*d* they are drawn in between third stage apron belts 18*c* and 18*d*. The process of thinning and elongating the thinned stream 13 then repeats in much the same manner as described above for the feed stream 9, which is thinned and elongated in and between the first stage 10 and the second stage 12. The third stage apron belts 18*c* and 18*d* are preferably an elastomeric material such as rubber, that provides a relatively great degree of friction between the fibers of the thinned stream 13 and the third stage apron belts 18*c* and 18*d*.

The third stage apron belts 18*c* and 18*d* are preferably tensionally secured about sets 20*c* and 20*d* of two or more rollers. In this manner, when any one of the rollers 20*c* and 20*d* are rotated, the third stage apron belts 18*c* and 18*d* are also rotated. The rotational power to the third stage apron belts 18*c* and 18*d* is provided by a stepper motor 54 (depicted in FIG. 2). The third stage apron belts 18*c* and 18*d* are driven in opposing rotational directions, such that the thinned stream 13 which is received between them is drawn in between them and ejected out from between them on the other side.

The directions of rotation are selected to coincide with the directions of rotation of the other rollers and belts mentioned above, such that the fibers are drawn along in the same direction throughout the individualizer 50. The speed at which the third stage apron belts 18*c* and 18*d* rotate is independently controlled by the speed control 42 (depicted in FIG. 2). The rotational speed of the third stage apron belts 18*c* and 18*d* is greater than the speed at which the second pinch rollers 16*c* and 16*d* rotate, the significance of which has been explained in great detail above, and which is briefly mentioned again below. In the preferred embodiment, the rotation speed of the third stage apron belts 18*c* and 18*d* is about 60 rpm.

Third platens 22*c* and 22*d* are disposed adjacent to and on opposing sides of the third stage apron belts 18*c* and 18*d*. Because the third stage apron belts 18*c* and 18*d* are preferably constructed of an elastomeric material, the third platens 22*c* and 22*d* provide some rigidity and resistance to the third stage apron belts 18*c* and 18*d* along a distance between the rollers 20*c* and 20*d* on which the third stage apron belts 18*c* and 18*d* are mounted. This rigidity and resistance helps to enhance the friction between the third stage apron belts 18*c* and 18*d* and the thinned stream 13 which is drawn between them.

The pressure between the third stage apron belts 18*c* and 18*d* and the fibers of the thinned stream 13 is further enhanced by placing pressure modules 24*c* and 24*d* adjacent each of the third platens 22*c* and 22*d*. In FIG. 1, a pressure module 24*c* is depicted adjacent the third upper platen 22*c*, which makes the third upper platen 22*c* a pressure platen, and a pressure module 24*d* is depicted adjacent the third lower platen 22*d*, which makes the third lower platen 22*d* a pressure platen. As previously mentioned, preferably only one of the third platens 22*c* and 22*d* is a pressure platen, and either the upper or the lower platen 22*c* and 22*d* may be selected and modified to be the pressure platen.

As described above, the pressure platens 22*c* and 22*d* are designed to allow a controlled degree of slip between the fibers of the thinned stream 13. Thus, when the fibers are between the third stage apron belts 18*c* and 18*d*, it is intended that some of the fibers advance through the third stage apron belts 18*c* and 18*d* at a faster rate than others of the fibers in the thinned stream 13. As fibers exit from between the third stage apron belts 18*c* and 18*d* at a greater rate than that at which they enter, the thinned stream 13 is further thinned as it moves between the third stage apron belts 18*c* and 18*d*. In other words, the fibers within the thinned stream 13 are individualized as they move through the third stage 14, in a manner as described in great detail above.

At the exit of the third stage apron belts 18*c* and 18*d*, the fibers of the thinned stream 13 are received by third pinch rollers 16*e* and 16*f*. The third pinch rollers 16*e* and 16*f* are preferably configured in a manner very similar to the first and second pinch rollers 16*a*, 16*b*, 16*c*, and 16*d*. In other words, one of the third pinch rollers 16*e* and 16*f* is preferably rubber and the other is preferably stainless steel. In alternate embodiments, the third pinch rollers 16*e* and 16*f* are configured as alternately described above.

Third adjustable pressure means 56*c* (depicted in FIG. 2) are used to adjust the pressure between the third pinch rollers 16*e* and 16*f*. The third adjustable pressure means 56*c* may be provided by one or more of several different mechanisms as explained above. As mentioned above for the second pinch rollers 16*c* and 16*d*, the materials from which the third pinch rollers 16*e* and 16*f* are formed are selected in part on their ability to finely grasp and provide friction to the fibers of the thinned stream 13. The adjustable pressure between the third pinch rollers 16*e* and 16*f* is also provided, in part, to enhance the ability of the third pinch rollers 16*e* and 16*f* to provide friction to the fibers of the thinned stream 13. In this manner, the fibers of the thinned stream 13 preferably do not slip between the third pinch rollers 16*e* and 16*f*.

Similar to that as previously described, the third pinch rollers 16*e* and 16*f* are rotated at the same speed and in opposing directions, so that the thinned stream 13 placed between them is drawn between the third pinch rollers 16*e* and 16*f* and ejected out from between the third pinch rollers 16*e* and 16*f* on the other side. A stepper motor 54 (depicted in FIG. 2) provides the rotation between the third pinch rollers 16*e* and 16*f*, and the speed control 42 (depicted in FIG. 2), in communication with the stepper motor 54, independently controls the speed at which the third pinch rollers 16*e* and 16*f* rotate. Preferably, the third pinch rollers 16*e* and 16*f* rotate at a speed that is greater than the speed at which the third stage apron belts 18*c* and 18*d* rotate. In the preferred embodiment, the third pinch rollers 16*e* and 16*f* rotate at a speed of between about 300 rpm and about 400 rpm.

Thus, the fibers of the thinned stream 13 are accelerated as they move through the third pinch rollers 16*e* and 16*f*.

This acceleration tends to thin out the thinned stream 13 as described above. To rehearse the explanation of how this is accomplished, as the fibers of the thinned stream 13 pass through the second pinch rollers 16*c* and 16*d*, the trailing ends of each of the fibers are retainably held between the second pinch rollers 16*c* and 16*d*. The leading ends of the fibers, however, are tensionally drawn between the third stage apron belts 18*c* and 18*d*.

The second pinch rollers 16*c* and 16*d*, because they exert sufficient pressure on the fibers so that they are not released, prevent the fibers from being pulled through the third stage at the faster rate at which the third stage apron belts 18*c* and 18*d* are rotating. Thus, the third stage apron belts 18*c* and 18*d* are dragging past the fibers at a greater speed than that at which they are allowed to travel by the second pinch rollers 16*c* and 16*d*.

As the trailing end of an individual fiber is released from between the second pinch rollers 16*c* and 16*d*, the pressure exerted on it by the third stage apron belts 18*c* and 18*d* cause the fiber to accelerate to the speed of the third stage apron belts 18*c* and 18*d*. Thus, the fiber so released accelerates past, and is drawn out from between the other fibers of the thinned stream 13 that are still retained between the second pinch rollers 16*c* and 16*d*. This action tends to thin and elongate the thinned stream 13, and completes the goal of individualizing the fibers.

As mentioned above, the pressure between the third stage apron belts 18*c* and 18*d* provides a controlled degree of slip between the fibers of the thinned stream 13. If the pressure between the third stage apron belts 18*c* and 18*d* is too great, it tends to break the fibers which have not yet been released from the second pinch rollers 16*c* and 16*d*. If the pressure between the third stage apron belts 18*c* and 18*d* is not great enough, then it is insufficient to accelerate the fibers that have been released from the second pinch rollers 16*c* and 16*d* past the other fibers of the thinned stream 13 that have not yet been released from the second pinch rollers 16*c* and 16*d*. Similarly, if the pressure between the second pinch rollers 16*c* and 16*d* is not great enough to prevent the fibers of the thinned stream 13 from slipping out between them, then the fibers may be pulled out by the pressure exerted between the third stage apron belts 18*c* and 18*d*, and the fibers will not be individualized in a uniform manner.

There is a second gap 38 of between about one-half inches and about six and one-half inches between the second stage 12 and the third stage 14. The width of this gap 38 is selected based in part on the length of the fibers within the thinned stream 13 that are processed through the individualizer 50. Preferably, the second gap 38 is set so that the distance between the second pinch rollers 16*c* and 16*d* and the third pinch rollers 16*e* and 16*f* is at least just greater than the length of the longest fibers in the thinned stream 13. As mentioned above, the reason for this is that both the second pinch rollers 16*c* and 16*d* and the third pinch rollers 16*e* and 16*f* exert sufficient pressure on the fibers that the fibers are retainably held by both the second pinch rollers 16*c* and 16*d* and the third pinch rollers 16*e* and 16*f*, and would break the fibers if they were held in each at the same time.

In a manner similar to that in which leading fibers are drawn out ahead of trailing fibers as the fibers exit the second pinch rollers 16*c* and 16*d* and enter the third stage apron belts 18*c* and 18*d*, so also are leading fibers drawn out ahead of trailing fibers as the fibers enter the third pinch rollers 16*e* and 16*f*. Because the third pinch rollers 16*e* and 16*f* rotate at a faster speed than do the third stage apron belts 18*c* and 18*d*, the third pinch rollers 16*e* and 16*f* cause the fibers which are drawn into them to slip past other fibers at a rate of speed that is greater than the speed of the third stage apron belts 18*c* and 18*d* and the speed of the second pinch rollers 16*c* and 16*d*.

Thus, fibers within the thinned stream 13 are moving at three different speeds in the area between the third stage apron belts 18*c* and 18*d*. The slowest moving fibers are those which are still retained between the second pinch rollers 16*c* and 16*d* and which are moving at the same speed as the second pinch rollers 16*c* and 16*d*. Accelerating past the slowest fibers are those which have been released from the second pinch rollers 16*c* and 16*d* and which are moving at the speed of the third stage apron belts 18*c* and 18*d*. Accelerating past both these slower two groups of fibers are those which have been drawn in by the third pinch rollers 16*e* and 16*f* and which are moving at the speed of the third pinch rollers 16*e* and 16*f*. Thus, these three speeds at which the fibers are moving tend to further draft the thinned stream 13, producing individualized fibers 15 at the outlet of the second stage 12.

The rate of speed at which the second stage apron belts 18*c* and 18*d* are rotating is sufficient that fibers may tend to wrap around the second stage apron belts 18*c* and 18*d*, rather than being conducted along with the other fibers and being further processed. To reduce the occurrence of fibers wrapping around the second stage apron belts 18*c* and 18*d* in this manner, means are provided to urge the fibers of the thinned stream 13 along the proper path. As mentioned above, air knives 32*c* and 32*d* are preferably used to keep the fibers within the thinned stream 13.

The individualized fibers 15 are released one at a time from the third pinch rollers 16*e* and 16*f* and conducted along an air stream created at the entrance of a vacuum nozzle 26. Although the third pinch rollers 16*e* and 16*f* are also rotating at a speed sufficient that fibers 15 may tend to wrap around them, the draft created by the vacuum nozzle 26 is preferably great enough that the fibers 15 are drawn into the vacuum nozzle 26 and do not wrap around the third pinch rollers 16*e* and 16*f*. Thus, in the preferred embodiment, air knives are not required at the outlet of the third pinch rollers 16*e* and 16*f*. However, air knives could be placed at the outlet of the third pinch rollers 16*e* and 16*f*, and also at the outlet of any of the other rollers and belts mentioned above.

There is a third gap 36 of between about zero inches and about one-quarter inches between the third stage 14 and the vacuum nozzle 26. Preferably, this gap is set once for optimal performance of the apparatus, and then should not require further adjustment. The length of the vacuum nozzle 26 is preferably sufficient such that fibers 15 do not extend past the innermost part of the vacuum nozzle 26 prior to being release by the third pinch rollers 16*e* and 16*f*. In this manner, the several individualized fibers 15 that may be within the vacuum nozzle 26 at any given time tend to not tangle prior to being released. To further prevent the individualized fibers 15 from tangling, the airflow drawn into the vacuum nozzle 26 is preferably non-turbulent. Thus, the air flows into the vacuum nozzle 26 in a laminar manner, and the individualized fibers 15 are not entangled one with another by swirling air currents. The shape of the vacuum nozzle 26 and the speed of the air flow within it are selected based in part on providing the non-turbulent air flow. The speed of the air flow is preferably greater than the linear velocity at the circumference of the third pinch rollers 16*e* and 16*f*. The non-turbulent air stream within the vacuum nozzle 26 may also be thought of as a drafting stage, due to the non-linear velocity of the air stream as it is drawn through the vacuum nozzle and the design of the vacuum nozzle 26.

The vacuum for the nozzle 26 is received from a vacuum source 34 via line 28. The vacuum source 34 draws the individualized fibers 15 through an analyzer 30. The analyzer 30 preferably includes sensors, memory, buss lines, software, firmware, and other hardware required for detecting and analyzing physical properties of the individualized fibers 15 as they are received from the third stage 14. For example, the analyzer 13 may determine the color, moisture content, length, or tensile strength of the individualized fibers 15.

While the invention has been described in detail, it is apparent to persons skilled in the relevant art that the invention may be modified without departing from the spirit of the invention. Various changes of form, design or arrangement may be made to the invention without departing from the spirit and scope of the invention. Therefore, the above-mentioned description is to be considered exemplary, rather than limiting, and the true scope of the invention is that as defined in the following claims.

What is claimed is:

1. An apparatus for individualizing fibers within a feed stream without breaking the fibers, comprising:

a first stage having first pinch rollers, for receiving the feed stream and providing the feed stream to a second stage, the first pinch rollers applying a pressure to the feed stream sufficient to prevent the fibers of the feed stream from slipping between the first pinch rollers and for releasing each of the fibers to the second stage when a trailing edge of each of the fibers exits from between the first pinch rollers, the second stage for receiving the feed stream from the first stage and providing a thinned stream to a third stage, and having, second stage apron belts for drawing the feed stream from the first stage under tension into the second stage, for receiving the feed stream between the second stage apron belts, and the second stage apron belts applying a pressure to the feed stream, where the pressure applied by the second stage apron belts to the feed stream induces the tension and the tension is not sufficient to break the fibers within the feed stream, and the tension is sufficient to accelerate the fibers released from the first pinch rollers past fibers that have not been released from the first pinch rollers, and second pinch rollers for drawing the feed stream from the second stage apron belts under tension and providing the thinned stream to the third stage, the second pinch rollers spaced from the first pinch rollers by a distance that is greater than an anticipated length of the fibers in the feed stream, the second pinch rollers applying a pressure to the feed stream sufficient to prevent the fibers of the feed stream from slipping between the second pinch rollers and for releasing each of the fibers to the third stage when the trailing edge of each of the fibers exits from between the second pinch rollers, and the third stage for receiving the thinned stream from the second stage and providing individualized fibers, and having:

third stage apron belts for drawing the thinned stream from the second stage under tension into the third stage, the thinned stream received between the third stage apron belts, and the third stage apron belts applying a pressure to the thinned stream, where the pressure applied by the third stage apron belts to the thinned stream induces the third stage tension and the third stage tension is not sufficient to break the fibers within the thinned stream, and the third stage tension is sufficient to accelerate the fibers released from the second pinch rollers past fibers that have not been released from the second pinch rollers, and third pinch rollers for drawing the thinned stream from the third stage apron belts under tension and providing the individualized fibers, the third pinch rollers spaced from the second pinch rollers by a distance that is greater than the anticipated length of the fibers in the thinned stream, the third pinch rollers applying a pressure to the thinned stream sufficient to prevent the fibers of the thinned stream from slipping between the third pinch rollers and for individually releasing each of the fibers when a trailing edge of each of the fibers exits from between the third pinch rollers.

2. The apparatus of claim 1 further comprising second platens disposed adjacent the second stage apron belts, for providing pressure on the feed stream and allowing the fibers within the feed stream to slip to a controlled degree.

3. The apparatus of claim 2 wherein at least one of the second platens is a pressure platen for adjusting the pressure on the feed stream between the second stage apron belts.

4. The apparatus of claim 1 further comprising third platens disposed adjacent the third stage apron belts, for providing pressure on the thinned stream and allowing the fibers within the thinned stream to slip to a controlled degree.

5. The apparatus of claim 4 wherein at least one of the third platens is a pressure platen for adjusting the pressure on the thinned stream between the third stage apron belts.

6. The apparatus of claim 1 further comprising stepper motors for driving each of the first, second, and third pinch rollers and the second and third stage apron belts.

7. The apparatus of claim 1 further comprising a speed control for separately controlling rotation rates of each of the first, second, and third pinch rollers and the second and third stage apron belts.

8. The apparatus of claim 1 further comprising a track, at least one of the first, second, and third stages adjustably mounted to the track for increasing and decreasing gaps between the first, second, and third stages.

9. The apparatus of claim 8 further comprising a first gap of between about one-half inches and about four and one-half inches between the first and second stages.

10. The apparatus of claim 8 further comprising a second gap of between about one-half inches and about six and one-half inches between the second and third stages.

11. The apparatus of claim 1 further comprising:

the first pinch rollers rotating at a rate of about 5 rpm, the second stage apron belts rotating at a rate of about 15 rpm, the second pinch rollers rotating at a rate of about 30 rpm the third stage apron belts rotating at a rate of about 60 rpm, and the third pinch rollers rotating at a rate of between about 300 rpm and about 400 rpm.

12. The apparatus of claim 1 further comprising a vacuum nozzle disposed adjacent the third stage for drawing individualized fibers from the third stage.

13. The apparatus of claim 12 further comprising a third gap of between about zero inches and about one-quarter inches between the third stage and the vacuum nozzle.

14. The apparatus of claim 12 wherein the vacuum nozzle draws the individualized fibers from the third stage with a non-turbulent air flow.

15. The apparatus of claim 12 further comprising an analyzer for receiving the individualized fibers from the vacuum nozzle and detecting physical properties of the individualized fibers.

16. The apparatus of claim 15 wherein the physical properties further comprise length of the individualized fibers.

17. The apparatus of claim 1 further comprising:

first adjustable pressure means for adjusting pressure between the first pinch rollers and preventing the fibers within the feed stream from slipping between the first pinch rollers, second adjustable pressure means for adjusting pressure between the second pinch rollers and preventing the fibers within the thinned stream from slipping between the second pinch rollers, and third adjustable pressure means for adjusting pressure between the third pinch rollers and preventing the individualized fibers from slipping between the third pinch rollers.

18. The apparatus of claim 1 further comprising second air knives disposed adjacent the second pinch rollers for removing fibers from the second pinch rollers.

19. The apparatus of claim 1 further comprising third air knives disposed adjacent the third stage apron belts for removing fibers from the third stage apron belts.

20. The apparatus of claim 1 wherein the fibers further comprise wool and the feed stream further comprises toe.

21. An apparatus for individualizing wool fibers within a toe without breaking the fibers comprising:

a track, a first stage for receiving the toe and providing the toe to a second stage, and having;

first pinch rollers rotating at a rate of about 5 rpm, for drawing the toe into the first stage, and first adjustable pressure means, for adjusting pressure between the first pinch rollers and preventing the wool fibers within the toe from slipping between the first pinch rollers, a first adjustable gap of between about one-half inches and about four and one-half inches between the first and second stages, the second stage adjustably mounted to the track, for receiving the toe from the first stage and providing a thinned toe to a third stage, and having;

second stage apron belts rotating at a rate of about 15 rpm, for drawing the toe from the first stage under tension into the second stage, second platens disposed adjacent the second stage apron belts, at least one of the second platens being a pressure platen, for adjusting pressure on the toe between the second stage apron belts and allowing the wool fibers within the toe to slip to a controlled degree, second pinch rollers rotating at a rate of about 30 rpm, for drawing the toe from the second stage apron belts under tension and providing the thinned toe, second adjustable pressure means for adjusting pressure between the second pinch rollers and preventing the wool fibers within the toe from slipping between the second pinch rollers, and second air knives disposed adjacent the second pinch rollers, for removing wool fibers from the second pinch rollers, a second adjustable gap of between about one-half inches and about six and one-half inches between the second and third stages, the third stage adjustably mounted to the track, for receiving the thinned toe and providing individualized wool fibers to a vacuum nozzle, and having;

third stage apron belts rotating at a rate of about 60 rpm, for drawing the thinned toe from the second stage under tension into the third stage, third platens disposed adjacent the third stage apron belts, at least one of the third platens being a pressure platen, for adjusting pressure on the thinned toe between the third stage apron belts and allowing the wool fibers within the thinned toe to slip to a controlled degree, third pinch rollers rotating at a rate of between about 300 rpm and about 400 rpm, for drawing the thinned toe from the third stage apron belts under tension and providing the individualized wool fibers, third adjustable pressure means for adjusting pressure between the third pinch rollers and preventing the wool fibers within the thinned toe from slipping between the third pinch rollers, and third air knives disposed adjacent the third stage apron belts, for removing wool fibers from the third stage apron belts, the vacuum nozzle for drawing individualized wool fibers from the third stage with a non-turbulent air flow and providing the individualized wool fibers to an analyzer, the analyzer for receiving the individualized wool fibers from the vacuum nozzle and detecting physical properties of the individualized fibers, stepper motors for driving each of the first, second, and third pinch rollers and the second and third stage apron belts, and a speed control for separately controlling rotation rates of each of the first, second, and third pinch rollers and the second and third stage apron belts.

22. A method for individualizing fibers within a feed stream without breaking the fibers, comprising:

providing the feed stream to first pinch rollers, the first pinch rollers rotating at a speed, increasing the pressure between the first pinch rollers until the fibers of the feed stream do not slip between the first pinch rollers, drawing the fibers under tension from the first pinch rollers between second stage apron belts, the second stage apron belts rotating at a speed greater than the speed of the first pinch rollers, releasing each of the fibers from the first pinch rollers when a trailing end of each of the fibers exits the first pinch rollers, adjusting the pressure on the fibers between the second stage apron belts to allow a controlled degree of slip between the fibers without breaking the fibers and sufficient to accelerate fibers that have been released from the first pinch rollers past fibers that have not been released from the first pinch rollers, drawing the fibers under tension from the second stage apron belts to second pinch rollers, the second pinch rollers rotating at a speed greater than the speed of the second stage apron belts, the second pinch rollers spaced from the first pinch rollers at a distance that is greater than an anticipated length of the fibers, increasing the pressure between the second pinch rollers until the fibers do not slip between the second pinch rollers, drawing the fibers under tension from the second pinch rollers between third stage apron belts, the third stage apron belts rotating at a speed greater than the speed of the second pinch rollers, releasing each of the fibers from the second pinch rollers when the trailing end of each of the fibers exits the second pinch rollers, adjusting the pressure on the fibers between the third stage apron belts to allow a controlled degree of slip between the fibers without breaking the fibers and sufficient to accelerate fibers that have been released from the second pinch rollers past fibers that have not been released from the second pinch rollers, drawing the fibers under tension from the third stage apron belts to third pinch rollers, the third pinch rollers rotating at a speed greater than the speed of the third stage apron belts, the third pinch rollers spaced from the second pinch rollers at a distance that is greater than the anticipated length of the fibers, increasing the pressure between the third pinch rollers until the fibers do not slip between the third pinch rollers, and releasing the fibers from the third pinch rollers as individualized fibers.

23. The method of claim 22 further comprising the step of receiving the individualized fibers from the third pinch rollers in a non-turbulent air flow through a vacuum nozzle.

24. A method for individualizing fibers within a feed stream without breaking the fibers, comprising:

providing the feed stream to first pinch rollers, the first pinch rollers rotating at a speed, increasing the pressure between the first pinch rollers until the fibers of the feed stream do not slip between the first pinch rollers, drawing the fibers under tension from the first pinch rollers between second stage apron belts, the second stage apron belts rotating at a speed greater than the speed of the first pinch rollers, adjusting the pressure on the fibers between the second stage apron belts to allow a controlled degree of slip between the fibers, drawing the fibers under tension from the second stage apron belts to second pinch rollers, the second pinch rollers rotating at a speed greater than the speed of the second stage apron belts, increasing the pressure between the second pinch rollers until the fibers do not slip between the second pinch rollers, drawing the fibers under tension from the second pinch rollers between third stage apron belts, the third stage apron belts rotating at a speed greater than the speed of the second pinch rollers, adjusting the pressure on the fibers between the third stage apron belts to allow a controlled degree of slip between the fibers, drawing the fibers under tension from the third stage apron belts to third pinch rollers, the third pinch rollers rotating at a speed greater than the speed of the third stage apron belts, increasing the pressure between the third pinch rollers until the fibers do not slip between the third pinch rollers, releasing the fibers from the third pinch rollers as individualized fibers, receiving the individualized fibers from the third pinch rollers in a non-turbulent air flow through a vacuum nozzle, drawing the individualized fibers in the non-turbulent air flow from the vacuum nozzle through an analyzer, and measuring physical properties of the individualized fibers with the analyzer.

25. The method of claim 23 further comprising the step of spacing the third pinch rollers and the vacuum nozzle apart by a third gap of between about zero inches and about one-quarter inches.

26. The method of claim 22 further comprising the step of spacing the first pinch rollers and the second stage apron belts apart by a first gap of between about one-half inches and about four and one-half inches.

27. The method of claim 22 further comprising the step of spacing the second pinch rollers and the third stage apron belts apart by a second gap of between about one-half inches and about six and one-half inches.

28. The method of claim 22 wherein the speeds of the first pinch rollers, the second stage apron belts, the second pinch rollers, the third stage apron belts, and the third pinch rollers further comprise about 5 rpm, about 15 rpm, about 30 rpm, about 60 rpm, and between about 300 rpm and about 400 rpm, respectively.

29. The method of claim 22 further comprising the steps of:

removing fibers from the second pinch rollers with air knives, and removing fibers from the third stage apron belts with air knives.

30. The method of claim 22 wherein the fibers further comprise wool and the feed stream further comprises toe.

* * * * *